United States Patent [19]

Seifert

[11] 3,948,165

[45] Apr. 6, 1976

[54] CONE PRESS

[75] Inventor: Peter Seifert, Middletown, Ohio

[73] Assignee: The Black Clawson Company, Middletown, Ohio

[22] Filed: Mar. 28, 1975

[21] Appl. No.: 563,124

[52] U.S. Cl. ..... 100/116; 100/158 R; 308/170

[51] Int. Cl.[2] ..... B30B 9/06; B30B 3/04

[58] Field of Search ..... 100/116, 158 R, 158 C, 100/170; 308/160, 168, 170, 172; 241/254

[56] References Cited

UNITED STATES PATENTS

| | | | |
|---|---|---|---|
| 3,086,453 | 4/1963 | Asplund | 100/158 C |
| 3,105,434 | 10/1963 | Messing | 100/158 C |
| 3,424,505 | 1/1969 | Pizzitola | 308/160 X |
| 3,447,450 | 6/1969 | Wilhelm | 100/158 C X |
| 3,451,731 | 6/1969 | Weichel | 308/170 X |
| 3,698,311 | 10/1972 | Yoritomi | 100/116 X |
| 3,753,604 | 8/1973 | Arsenius | 308/160 |

*Primary Examiner*—Peter Feldman
*Attorney, Agent, or Firm*—Biebel, French & Nauman

[57] ABSTRACT

A press, including a frame, a pair of rigid side structures, means for pivotally connecting the side structures to said frame, a pair of rotor assemblies having confronting faces arranged at an angle to each other and defining a pressing zone, each of the rotor assemblies being mounted for rotation in a respective side member, means interconnecting the side structures to one another and serving to apply yieldable force to urge the side structures toward one another, the improvements basically comprising means for adjusting the pivotal connecting means to vary the pressing action of the rotor assemblies, a hydrostatic bearing means, which may be used in association with an annular thrust bearing, for lubricating and minimizing the friction between the rotor assemblies and the side structures, and a biased sealing means for preventing moisture in the feed materials from rewetting the pressed solids leaving the press.

5 Claims, 12 Drawing Figures

CONE PRESS

BACKGROUND OF THE INVENTION

This invention relates generally to presses of the continuous type such as are employed for extracting water or other liquids for various fluids or semi-fluid feed materials, and specifically to cone presses wherein the screening surfaces are shaped to conform to truncated cones.

Although the invention will be described in terms of extracting water from paper pulps or slurries, the invention is also applicable in extracting liquid from said other pulps, slurries, and semi-solid materials. Examples of other materials include sewage sludges, vegetable and fruit pulps, tomato and grape pomace, citrus peel, fish or fish process slurries, cannery wastes, and brewers and distillers grains.

In extracting liquids from feed materials in a press, filter screens are caused to compress the solids of the feed to effect a reduction in volume, which in turn causes liquid to be expelled through the screen. In a cone press, a pair of rotating wheels or disks are faced with screens shaped to conform to truncated cones, and the volumetric compression is done by the co-acting cones.

The construction of the cone press is such that the axes of rotation of the cone wheels are normally intersecting but out of alignment whereby the screens are brought into close opposition in a pinch or nip region, but are separated apart a substantial distance in a wide region diametrically opposite the pinch region. The two cone wheels are driven continuously in the same direction, usually by gear pinions on a common drive shaft which mesh with gear teeth provided on the peripheries of the wheels or by a chain drive which also operates on teeth on the peripheries of the wheels. A casing extends between the peripheries of the wheels and is provided with an inlet for the feed slurry and also with an outlet for the removal of the squeezed or dewatered solids. A partition member or plow extends between the cone wheels from one portion of the casing to the center area between the cones and serves to direct the flow of material between the screen surfaces.

In operation, the feed is continuously introduced in the wide region of the inlet and continuously carried between the screens through the pinch or nip region. The squeezed or dewatered solids are withdrawn at the outlet shortly after passing through the nip region, and the liquid is caused to be expressed through the screens, and is collected by an appropriate means. In one form of early prior such continuous press, the location of the wheels remained fixed during operation, so that the spacing of the screens in the pinch region remained constant.

Continuous presses of the prior type described above are subject to a number of disadvantages. The performance and capacity of such a press is dependent upon the rate of feed and also upon variations in the solids content of the feed material. This is because the pressure applied to the solids in the pinch region varies with the amount of solids present, and this in turn is dependent upon the rate of feed and the solids content of the feed. At high feed rates, overloading of the press can occur. In many instances, this has the effect of limiting the overall capacity of the machine, and it also interferes with attainment of a desired residual liquid content in the expressed solids and in the maintenance of a desired residual liquid content over long operating periods.

Another disadvantage of the early prior cone presses is that the means generally employed to take the thrust against the core wheels have been thrust rollers tracking on the outer faces of the wheels, or bearings into which the cone wheel support shaft is journalled, and these are generally unsatisfactory because they are complicated and subject to excessive wear. Further, such prior continuous presses have not been amenable to quick adjustments to accommodate different types of feed materials, and their design has not facilitated ready access to the screens for replacement or repair, or for cleaning.

More recent prior cone presses wherein the cone wheel supports are pivotally connected with respect to a fixed point will allow adjustment to maintain a constant pressing force. They do so by adjusting mainly the nip width, which is the distance between the conical screen surfaces at the point of their closest proximity. As a result, the compression ratio, which is the ratio between the large feed flow area and the small nip flow area, also changes. However, the distribution of nip widths and of the compression ratios along the radius of the cone wheels changes in a preset, i.e., non-adjustable, manner. Typical such presses are shown in U.S. Pat. Nos. 3,447,450 (Wilhelm) and, 3,105,434 (Messing).

A cone press according to U.S. Pat. No. 3,447,450 (Wilhelm), which features support structures for the wheels with pivotal supports on one end of the support structures and a yieldable connection at the other end of the support structures, exhibits a complicated relationship between compression ratio and nip width. As an example, when the side structures are moved apart, the nip width changes along the radius of the wheel, namely, it becomes greater for greater radii. The compression ratio will also change, namely it generally decreases, but the rate of decrease is greater at greater radii. As a result, the residual moisture content of material at the greater radii would be greater than the moisture content of the material in the center areas. Thus, when more material is fed in the press, the discharge in the outer regions — of greater radii — will become relatively wet.

In order to overcome the problems caused by using thrust rollers, some presses have employed a friction pad, such as a high density polyethylene or nylon annulus. Such a thrust bearing structure is relatively simple in construction and allows for a uniform distribution of the thrust generated in the pressing operation. But such structures require a high power input in order to overcome the friction between the pads and the rotating disk.

Yet an additional problem with prior press structures is that generally no provision was made to prevent moisture from leaking past the tapered barrier or plow structure and rewetting the dewatered solids when the press was used to dewater a low solids content slurry. Presses have employed rubber strips between the rotating assemblies and the stationary frame, but they did not seal the center or hub area. Sealing is a further problem in presses wherein the cone wheels are pivotally connected.

Thus a need exists for an improved press which has a more uniform dewatering capability, an improved thrust bearing means, and an improved seal means associated with the barrier or plow structure.

SUMMARY OF THE INVENTION

The invention is broadly an improved press, and specifically an improved cone press having a more uniform dewatering capability, an improved thrust bearing means, and an improved sealing means which prevents leakage from the inlet section of the pressing zone to the outlet section.

The basic press structure comprises a frame, a pair of rigid side structures pivotally supported on the frame, and a pair of rotor assemblies having confronting faces covered with cone shaped screens arranged at an angle to each other which define a pressing zone. Each of the rotor assemblies is mounted for rotation in a respective side member, and means are provided to interconnect the side structures to one another and to apply a yieldable force to urge the side structures toward one another. The side structures are hingedly connected to the frame by hinge pins passed through brackets extending from the side structures.

The present invention provides a press in which both the radial distribution of the volumetric compression ratio and the radial distribution of the width of the nip are adjustable to provide a more uniform dewatering capability by providing a means for adjusting the pivotal connection. In one embodiment, a plurality of hinge openings are provided in the frame and the hinge brackets. By matching openings in the hinge bracket with openings in the frame, a plurality of hinge points are available for adjusting the point of pivot. To readjust, the hinge pin is pulled out, another of the openings of the hinge bracket is superposed over another of the openings in the frame, and the hinge pin is reinserted. Alternative pivotal adjustment means include screw adjustment means, hydraulic adjustment means, and eccentric adjustment means.

In order to appreciate fully the need for the extra adjustment in the cone press, the various factors which affect pressing should once more be considered. The three factors which — in a given process operation — will provide the thickening action are:

1. Time.
2. Compression Ratio.
3. Nip Width.

In a press consisting of two parallel cylinders, all three factors are constant along the entire length of the nip. The pressing result is therefore uniform along the entire length of the nip. In cone presses, however, only two of the three factors can be held constant because of geometrical necessity. The pressing time will be the same, no matter at what point of the radius the furnish enters the press. If the nip width is held constant along the radius, the compression ratio varies. It would be higher in the outer regions (largest radius) and lower in the inner regions (smallest radius) of the press; thus yielding a drier material on the outside and a wetter material on the inside regions.

If one attempts to maintain constant compression ratio, the nip width will vary; namely, it will be greater in the outer regions and smaller in the inner regions of the press, yielding wetter discharge material on the outside and drier discharge material on the inside regions. This difficulty was recognized by the above Wilhelm patent by a press utilizing a compromising configuration, where both nip width and compression ratio are varied in a fixed relationship. It is apparent that the compromise, while it may be beneficial for one material, may not be an optimal solution for another with different dewatering characteristics. The possibility of adjusting the pivot points of the press in the field is therefore a significant improvement over the existing presses.

The improved thrust bearing means are hydrostatic bearings comprising an annular plate extending toward the rotor assembly from the side structures and having formed therein relatively shallow flat pockets which are located opposite the nip area or pinch zone of the press. Lubricant or other fluid is fed into the pocket, via an inlet in the bottom of the pocket, so that the pocket fills with fluid. The rotor assembly can carry an annular thrust bearing pad of high density polyethylene or nylon for rotation against the fluid-filled pocket. If this fluid in the pockets is pressurized to compensate hydraulically for the major portion of the thrust load, there will be lower friction forces between each cone and its supporting structure, thus reducing the power required to drive the press. Additionally, the bearing is relatively simple, which minimizes the possibilities for mechanical breakdown and wear.

The hydrostatic bearing can be operated by expending a certain amount of lubricant, or by incorporating a U-shaped channel around each pocket, which channel is provided with a return line so that lubricant which over-flows the pocket of the hydrostatic bearing can be collected in the channel and returned for recirculation and reuse. Also, the lubricant can be cooled before it is fed to the bearing to provide cooling in the nip area.

The improved sealing means between the partition member or plow and the rotor assemblies comprises a pneumatically or hydraulically inflated sealing strip attached to the peripheral edge of the partition member. Alternatively, a spring biased sealing strip could be employed. The sealing strip will be in contact with the rotor screen surface and the rotor hub. The combination of these seals will prevent moisture in the feed from rewetting the pressed solids which are leaving, especially when the feed materials are low consistency. The bias of the seals will allow them to compensate for movement of the side structures.

Thus the invention provides a press which has a more uniform dewatering capability resulting in uniform dryness of the discharge materials, an improved thrust bearing means which is simple in design and results in a lowering of a power requirement, and an improved sealing means which prevents leakage across the partition member or plow from the inlet to the discharge sections.

It is an object of this invention to provide an improved press which includes one or more of these improvements, namely the adjustable pivotal connection, the hydrostatic bearing, and the improved plow sealing means.

Other objects and advantages of the invention will be apparent from the following description, the accompanying drawings and the appended claims.

DESCRIPTION OF THE PREFERRED EMBODIMENTS

Figure 1:
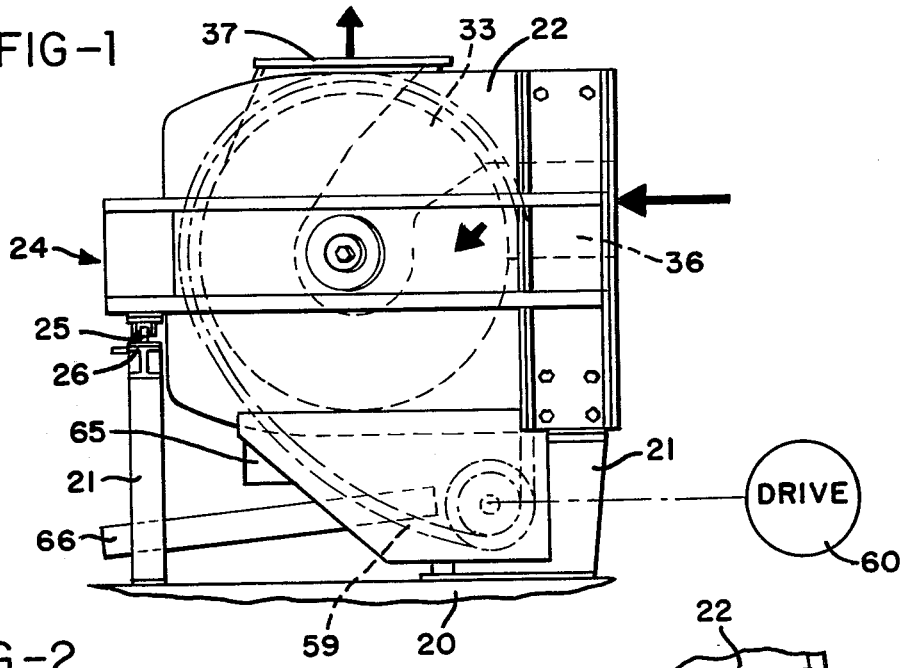
FIG. 1 is an elevational view of the improved cone press of the invention.

The press shown generally in FIG. 1 comprises a base 20 supporting a frame 21 on which a pair of rigid side structures 22 (also sometimes called doors) are pivotally supported. The pivots are indicated generally by the reference numeral 23, and will be discussed in more detail hereinafter. The other ends 24 of the side structures are generally free to move and are supported on roller bearings 25 on the surface of rail member 26.

One of a pair of rotating wheels or rotor assemblies 30 (FIG. 3) is mounted for rotation in each side member 22. The rotor assemblies 30 have confronting faces 31 arranged at an angle to each other so as to define a pressing zone. A partition member or plow 33 is located between the rotor assemblies 30 and serves to direct the flow of material to be pressed as it enters and leaves the pressing zone. A casing 35, which extends between the peripheries of the rotor assemblies and has an inlet 36 and an outlet 37, encloses the pressing zone and also confines the material between the faces 31.

Figure 3:
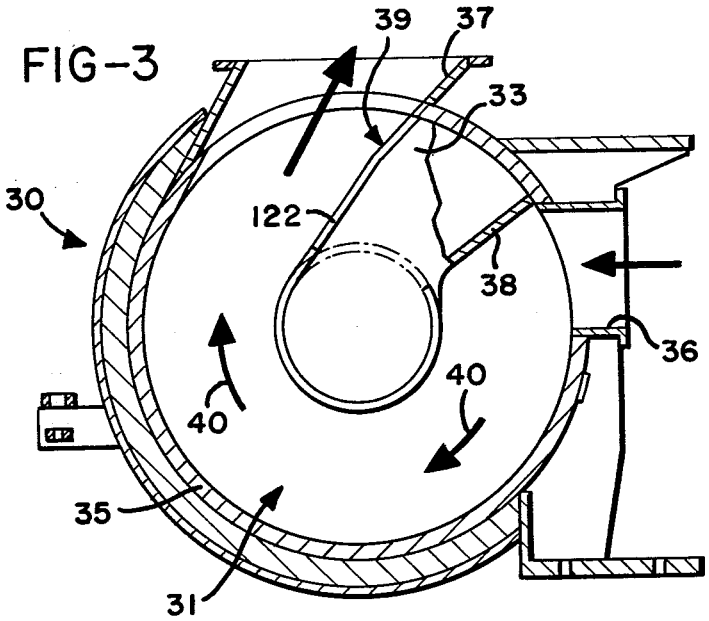
FIG. 3 is a cross-sectional view of the casing and partition member, shown partially in elevation, employed in the cone press of FIGS. 1 and 2.

Plow 33 is a generally U-shaped member comprising a circular portion located in a central zone, concentrically inward from the faces 31 of the rotor assemblies 30, and generally straight or leg portions 38 and 39 which extend generally radially from the central zone to the casing 35 and between the faces 31. As shown in FIG. 3, the material to be dewatered, such a paper pulp, enters the press at inlet 36 and is directed between the screening faces 31 by the inlet leg 38 of plow 33. The pulp then passes between the confronting faces 31 as shown by arrows 40 and leaves the press at outlet 37. The slurry or pulp is fed to inlet 36 by any appropriate feed conveyor, and removed from outlet 37 by any appropriate discharge conveyor, both such conveyors being conventional in the art.

Figure 4:
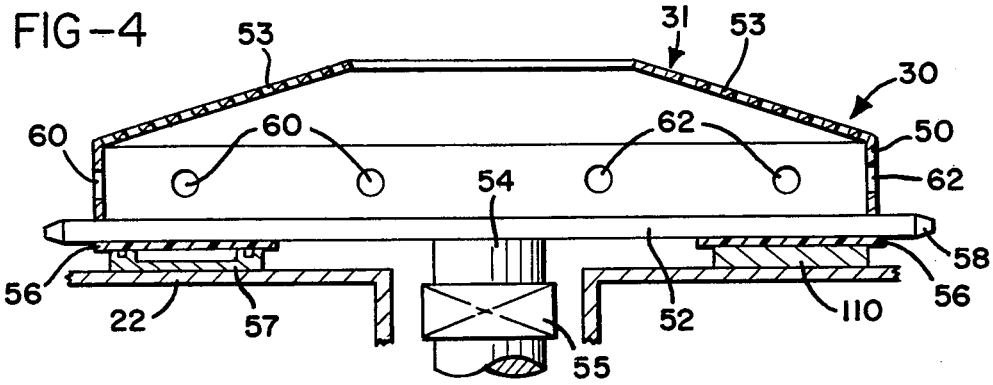
FIG. 4 is a cross-sectional view of one of the rotor members in the cone press of FIGS. 1 and 2.

One of the rotor assemblies 30 is shown in FIG. 4, and basically comprises a rim-like structure 50 attached to a backing or thrust bearing plate 52. The rim 50 provides a support for the screen 53, which is in the shape of a truncated cone.

Each rotor assembly 30 is mounted for rotation in side structure 22 by shaft 54 and bearing 55, which allow the rotor assembly to rotate freely in side structure 22. A thrust bearing 56 in the form of an annular pad of self-lubricating material such as high density polyethylene or nylon, either alone or graphite filled, is mounted near the peripheral edge of the backing plate 52 of rotor assembly 30 and cooperates with an annular plate 57 on side structure 22 to take the thrust forces generated in the pressing operation. The thrust pad also reduces the friction between the rotor assembly as it rotates and the side structure. The peripheral edge of the thrust plate is provided with a plurality of sprocket teeth 58 so that the rotor assembly can be driven by a chain drive 59 through a suitable drive 60.

When the pulp is compressed between the screening faces 31 of the screens 53, the pulp is reduced in volume while any liquid, such as water, is squeezed through the faces 31 to the interior of the rotor assemblies 30. Appropriate holes 62 are provided in the rotor assemblies 30 for removal of the extracted liquids therefrom. The liquid is then collected through a funnel-like throat 65 to a collector pan 66. The collected liquids can be reused or disposed of as desired.

A hydraulic means 70 interconnects the free ends 24 of side structures 22 and serves to apply yeildable force to urge the side structures 22 toward one another. Hydraulic means 70 comprises a double acting hydraulic cylinder 71 appropriately connected by hinge pins 72 to side structures 22. By applying hydraulic fluid to one side of the piston in hydraulic cylinder 71, the side structures 22 and faces 31 are caused to move toward one another. When hydraulic fluid is applied to the other side of the piston in cylinder 71, the side members 22 will move away from each other and increase the distance between faces 31. When the side members 22 move toward or away from one another, they will pivot about pivot points 23.

Figure 2:
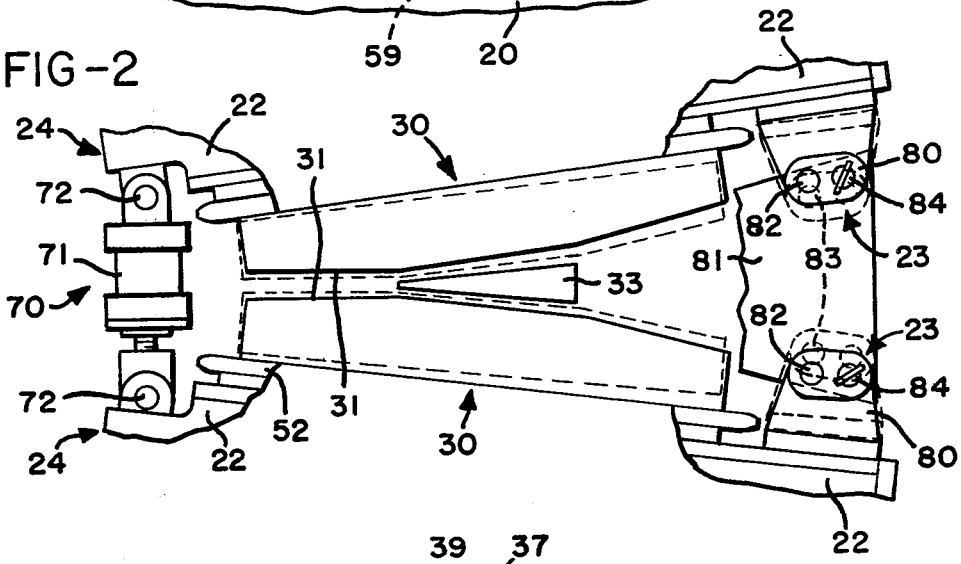
FIG. 2 is a fragmentary top view, partly broken away, of the cone press of FIG. 1.

While the adjustment between the faces 31, to effect greater dewatering, can be done by moving side members 22 toward or away from one another using hydraulic means 70, this has not proved entirely satisfactory, and so an adjustment means for adjusting the pivot points 23 has been provided in the improved press of the invention. One embodiment of the pivot adjustment is shown in FIG. 2, and comprises flanges 80 which are attached to side structures 22 and extend in a direction normal to side structures 22. Frame 21 includes a hinge bearing plate 81 which extends horizontally and joins the frame members 21. Holes 82 are provided in flanges 80, and corresponding holes 83 are provided in bearing plate 81 of frame 21. Hinge pins 84 are passed through holes 82 and 83 to join flanges 80 to plate 81 so that side members 22 will be allowed to pivot.

In order to provide an adjustment for the hinge point 23, plural holes 82 and 83 are provided in flanges 80 and plate 81. By moving flanges 80 to coincide one of holes 82 with one of holes 83 in plate 81, various combinations of hinge points are achieved, as well as adjustment of the distance between the side structures 22. As shown in FIG. 2, there are two sets of holes in each of the flanges 80 and each side of the plate 81, so there are two possible positions. Therefore the solid lines represent one of the positions, while the dotted lines represent the alternative position.

Figure 5:
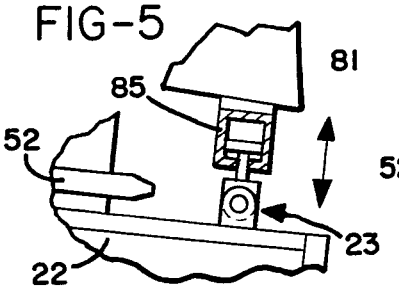
FIGS. 5 and 6 are fragmentary top views, partially broken away, of other embodiments of the adjustable pivotal connection between the side members of the cone press of the invention.

As can be appreciated, any number of combinations of holes 82 and 83 can be employed to provide a greater or lesser amount of variable positions. Alternatively, the adjustment can be provided by mechanically and/or hydraulically moving the hinge points on the stationary frame inwardly or outwardly, such as by placing a double acting hydraulic cylinder 85 between the hinge point 23 and the hinge bearing plate 81 as shown schematically in FIG. 5, so that the hinge point 23 is hydraulically moved away from or toward the plate 81, as well as frame 21, to provide the adjustment.

Figure 6:
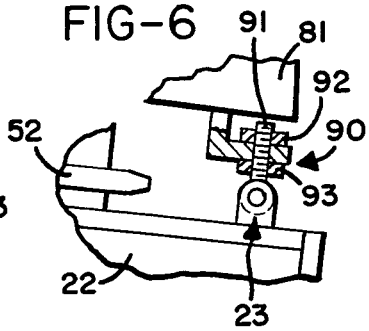

Another possible adjustment means is the screw mechanism 90 shown schematically in FIG. 6. Screw 91 is slidably attached, at one end, to hinge bearing plate 81 by nut members 92 and 93, and at the other end is attached by hinge point 23 to side member 22. By adjusting nut members 92 and 93, screw 91 is axially moved toward or away from plate 81, and consequently hinge point 23 is also moved inwardly or outwardly.

Figure 7:
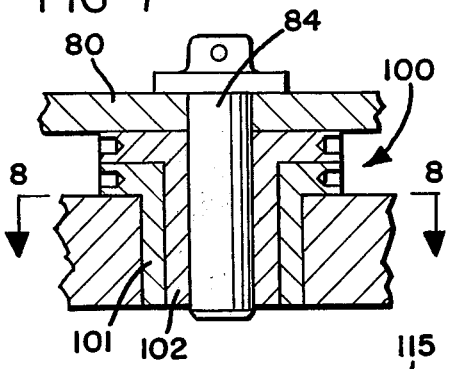
FIG. 7 is a fragmentary section on the lines 7—7 of FIG. 8 showing another modified such pivotal connections.
Figure 8:
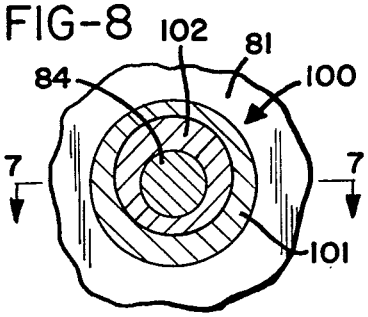
FIG. 8 is a section on the line 8—8 of FIG. 7.

A fourth embodiment of the adjustable pivotal connection is shown in FIGS. 7 and 8 and comprises an eccentric adjustment means 100. Pivot pin 84 is supported in a combination of eccentric bushings 101 and 102 which are adjusted by spanner wrenches and then held in place with set screws (not shown). By adjusting both bushings 101 and 102, movement of the pivot point 23 away from or toward the frame 21 is effected.

While the use of an annular thrust bearing pad is satisfactory for many purposes, including the fact that it is relatively simple in construction and operation, it does require a relatively high power input to overcome the friction between the pads and the rotor assemblies. Therefore, the present invention employs a hydrostatic bearing means which reduces the power input and, optionally, allows the nip area to be cooled.

Figure 10:
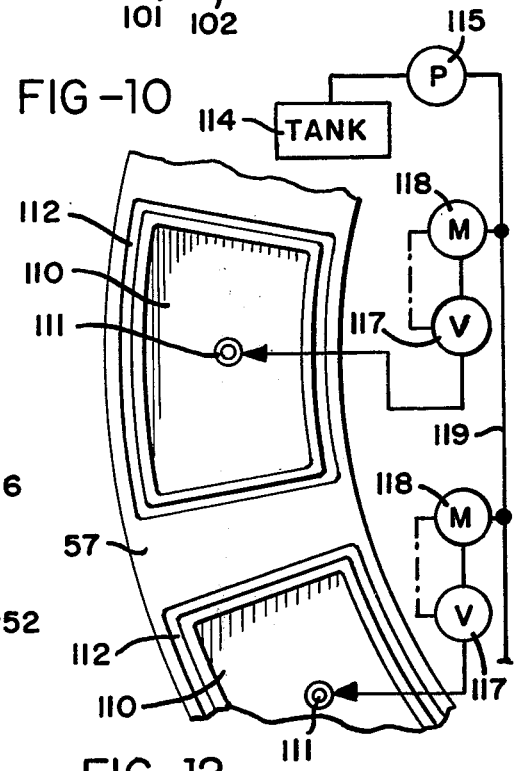
FIG. 10 is a fragmentary elevational view of the pocket portion of the hydrostatic bearing in FIG. 9.
Figure 9:
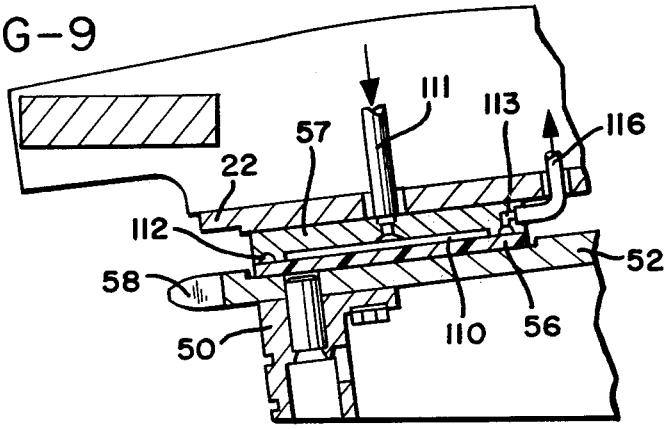
FIG. 9 is a cross-sectional view, partially broken away, of a rotor member and side structure employing the hydrostatic bearing used in the cone press of the invention.

As shown in FIGS. 9 and 10, the hydrostatic bearing means comprises the annular plate 57 fixed to the side member 22 opposite the bearing pads 56, and having relatively shallow, flat pockets 110 formed therein. An inlet 111 in the bottom of each pocket 110 admits pressurized fluid to the pocket. A U-shaped channel 112 is arranged around the pocket and has an outlet 113.

In operation, lubricant, such as high viscosity grease or other liquid, enters and fills each pocket 110 from inlet 114, supply system comprising a reservoir tank 114 and pump 115. The bearing will be in contact with annular bearing pad 56, although the press could be run without pad 56. A certain amount of lubricant will be allowed to escape from pockets 110 by overflowing in order to lubricate the contacting surfaces of pad 56 and plate 57. The lubricant can also overflow to channel 112 and be returned to the tank 114 by line 116. Further, if desired, the lubricant can be cooled by an appropriate means (not shown) before it is fed or recycled to pockets 110, and it is also desirable to provide individual control over the pressure in each of the pockets 110, as indicated by the flow control valve 117 and cooperating flow meter 118 connected between each of the pockets 110 in FIG. 10 and the supply line 119 from the pump 115 and supply tank 116. The overflow return lines will also preferably lead back to the tank.

Low solids or low consistency slurries present a problem when being dewatered in that they can leak past the partition member 33 by way of the space between it and the rotor surface 31. This generally is not a problem with high solids slurries because of their high viscosity, but the use of side structures which are movable toward or away from one another means that enough gap must be left to allow the rotor assemblies to be adjusted, and consequently a large enough gap or space may be left between the rotor surfaces and the partition member to permit material to short circuit past the partition member.

Figure 11:
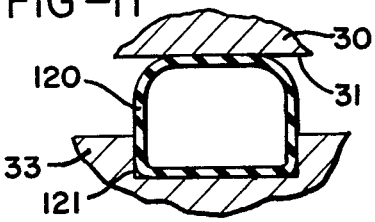
FIGS. 11 and 12 are fragmentary sectional views showing embodiments of the sealing means in the press of the invention.

In order to prevent leakage from the inlet to the outlet sections of the pressing zone, a biased flexible sealing strip 120 is embedded, as shown in FIG. 11, in a channel 121 in the side surface of the plow 33 facing the screen surface 31. The sealing strip 120 will be in contact with the screen face 31 of the opposite rotor assembly 30. The sealing strip 120 comprises a pneumatically or hydraulically inflated tubular material, of rubber, synthetic plastic and the like which, because it is biased by being pneumatically or hydraulically inflated, will compensate for increases and/or decreases in the spacing between the plow 33 and rotor assemblies 30 as the rotor assemblies are moved toward or away from each other.

Figure 12:
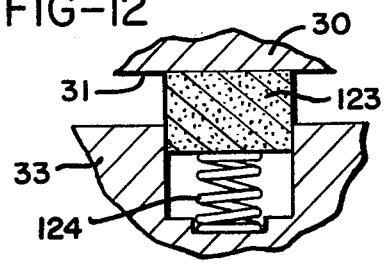

The total sealing means may comprise, in addition to the sealing strip 120, a further strip of sealing material 122 which is embedded in the discharge leg 39 of the plow 33 and comprises the same material as strip 120. Alternatively, as shown in FIG. 12, the sealing material can comprise a solid strip 123 of rubber or synthetic material, such as self-lubricating nylon or other plastic which is biased by a spring 124. Thus the improved sealing means provides for sealing in the hub area, in addition to the plow or partition means, and additionally allows for greater compensation of rotor movement in and out because it is a biased sealing means, in addition to comprising a flexible material.

While the forms of apparatus herein described constitute a preferred embodiment of the invention, it is to be understood that the invention is not limited to these precise forms of apparatus, and that changes may be made therein without departing from the scope of the invention which is defined in the appended claims.

What is claimed is:

1. A press comprising a frame, a pair of rigid side structures, means for pivotally connecting said side structures to said frame, a pair of rotor assemblies having their axes arranged at an angle to each other and including confronting faces defining a pressing zone, means mounting each of said rotor assemblies for rotation in a respective said side structure, means for applying yieldable force urging said side structures toward one another, and means for adjusting said pivotally connecting means to vary the pressing action of said rotor assemblies.

2. A press as defined in claim 1 wherein each said pivotal connecting means comprises a flange fixedly connected to said side structure and having plural hinge openings therethrough, and a hinge pin selectively inserted in one of said openings.

3. A press as defined in claim 1 wherein said means for adjusting said pivotal connecting means comprises screw adjusting means.

4. A press as defined in claim 1 wherein said means for adjusting said pivotal connecting means comprises hydraulic adjusting means.

5. A press as defined in claim 1 wherein said means for adjusting said pivotal connecting means comprises eccentric adjusting means.

* * * * *